US006158357A

United States Patent [19]

Shih

[11] Patent Number: 6,158,357

[45] Date of Patent: Dec. 12, 2000

[54] ON COMPUTER DESK

[76] Inventor: Tsung-Chin Shih, No. 72-2, Pei Juang Road, Pei Juang Village, Sun Kang Hsiang, Taichung Hsien, Taiwan

[21] Appl. No.: 09/426,637

[22] Filed: Oct. 25, 1999

[51] Int. Cl.[7] ..... A47B 37/00

[52] U.S. Cl. ..... 108/50.01; 108/94; 108/150

[58] Field of Search ..... 108/50.01, 50.02, 108/94, 103, 139, 150, 140; 312/223.3, 208.1; 211/150, 134, 153; 248/125.1, 282.1

[56] References Cited

U.S. PATENT DOCUMENTS

| | | | |
|---|---|---|---|
| 1,625,935 | 4/1927 | Cox | 211/153 |
| 4,401,036 | 8/1983 | Russo et al. | 108/150 X |
| 4,815,392 | 3/1989 | Soot | 108/94 X |
| 5,730,408 | 3/1998 | McAllister et al. | 108/140 X |
| 6,003,452 | 12/1999 | Moore | 108/50.01 X |

FOREIGN PATENT DOCUMENTS

| | | | |
|---|---|---|---|
| 3506381 | 8/1986 | Germany | 312/223.3 |

*Primary Examiner*—Janet M. Wilkens
*Attorney, Agent, or Firm*—Bacon & Thomas, PLLC

[57] ABSTRACT

A computer desk comprises a base, an upright support rod fastened at one end thereof with the base, a computer desktop mounted on other end of the upright support rod, a main unit desktop mounted on the base, a periphery desktop fastened with the upright support rod and located under the computer desktop, and a keyboard desktop fastened adjustably with the upright support rod by two pivoting pieces, a bracket, a pivoting seat, two fastening rods, and a plurality of receptacles, plastic bodies and screws.

3 Claims, 4 Drawing Sheets

ON COMPUTER DESK

FIELD OF THE INVENTION

The present invention relates generally to a desk, and more particularly to a computer desk.

BACKGROUND OF THE INVENTION

The conventional computer desks are generally provided with one or more desk tops of various sizes, which are fixed by welding and are therefore obstructive to the use or the movement of the computer main unit and the computer peripheral equipments.

SUMMARY OF THE INVENTION

The primary objective of the present invention to provide a computer desk which is free from the deficiencies of the conventional computer desks describes above.

In keeping with the principle of the present invention, the foregoing objective of the present invention is attained by a computer desk comprising a support rod which is vertically mounted on a support base, a computer desktop mounted on the top end of the support rod, a keyboard desktop fastened with the support rod, a periphery desktop fastened with the support rod such that the periphery desktop is located under the computer desktop, and a main unit desktop mounted on the support base. The keyboard desktop is adjustably fastened with the support rod such that the level, at which the keyboard desktop is located, can be adjusted in accordance with the need of a computer operator.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
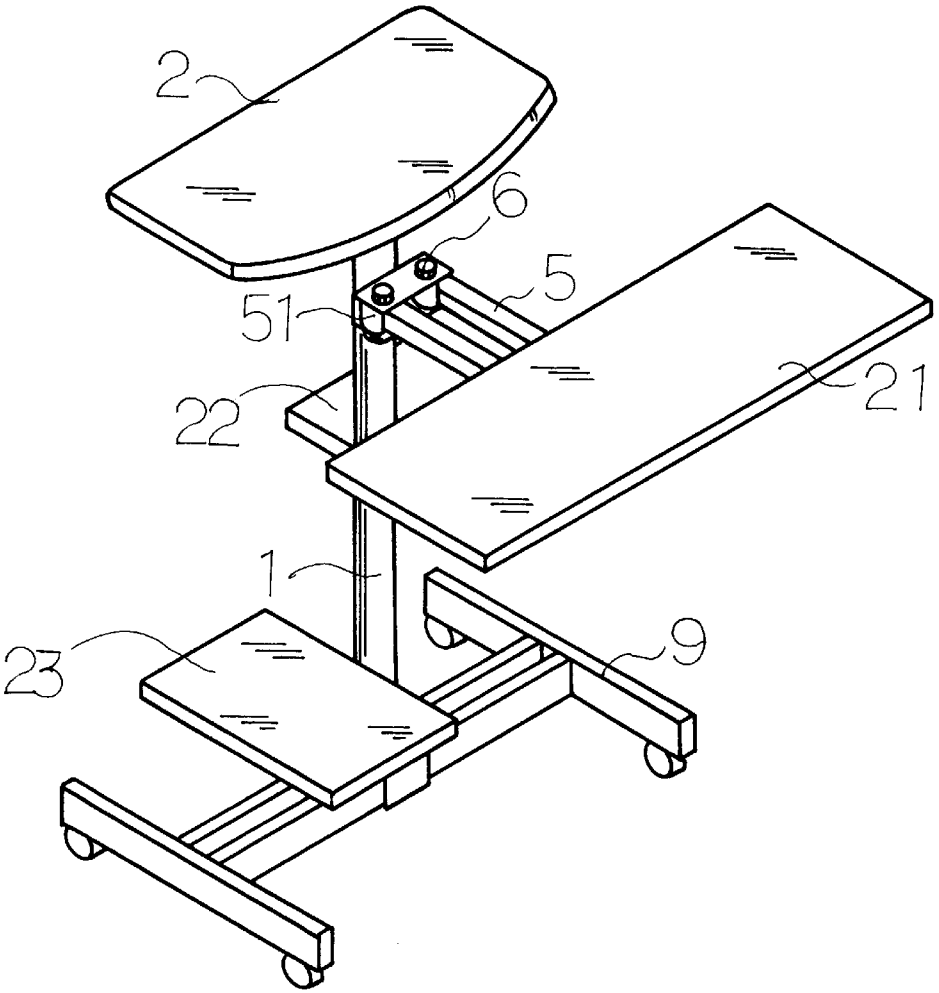
FIG. 1 shows a perspective view of a computer desk of the preferred embodiment of the present invention.
Figure 2:
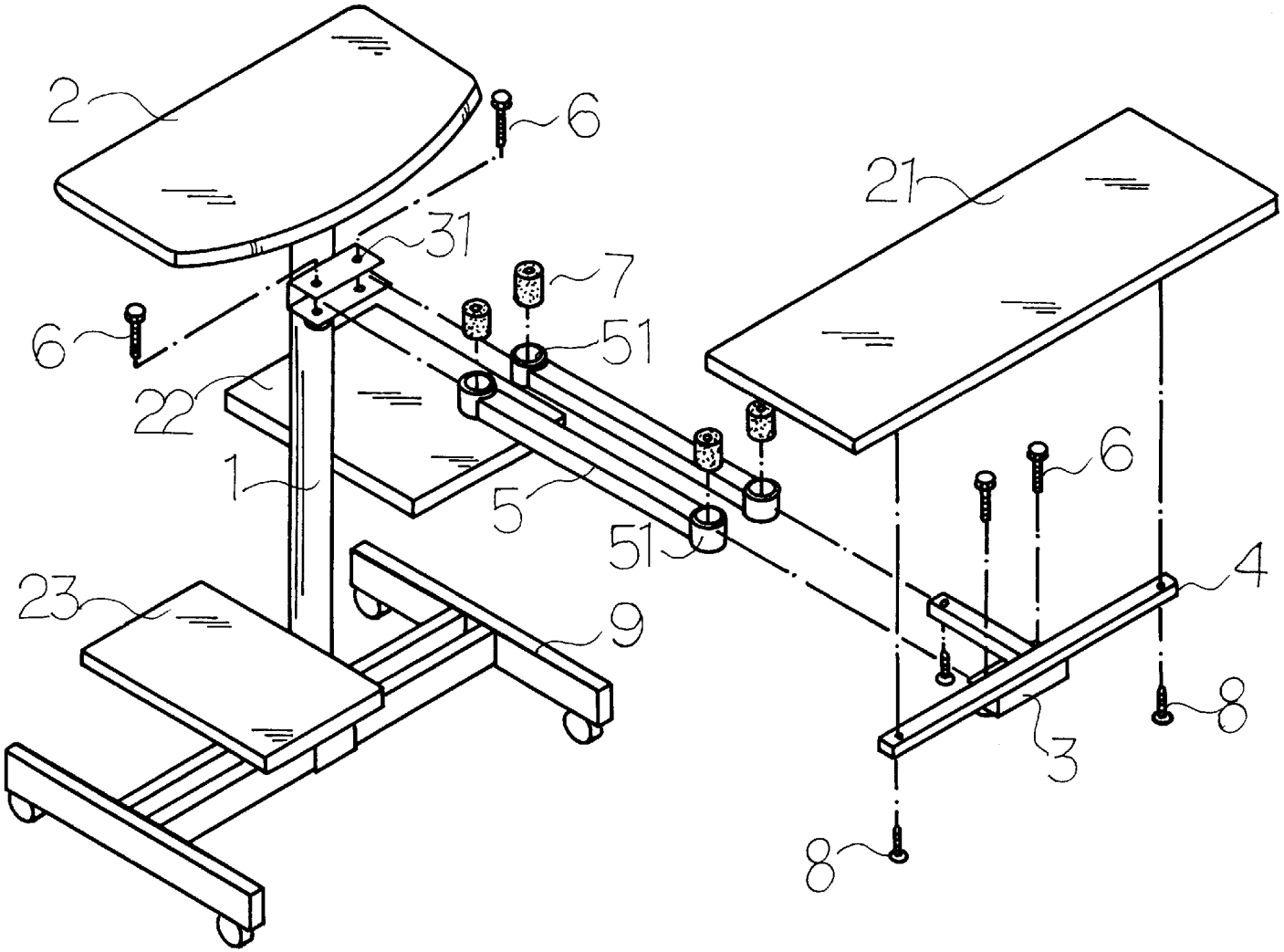
FIG. 2 shows a partial exploded view of the computer desk of the preferred embodiment of the present invention.

As shown in FIGS. 1 and 2, a computer desk embodied in the present invention is essentially composed of an upright support rod 1, a computer desktop 2, a keyboard desktop 21, a periphery desktop 22, a main unit desktop 23, and a support base 9.

The upright support rod 1 is vertically mounted at the bottom end thereof on the support base 9 of an I-shaped construction. The computer desktop 2 is mounted on the top ends of the support rod 1.

The keyboard desktop 21 is adjustably fastened with the upright support rod 1 by two fastening rods 5 in conjunction with a pivoting seat 3 and a bracket 4.

Figure 3:
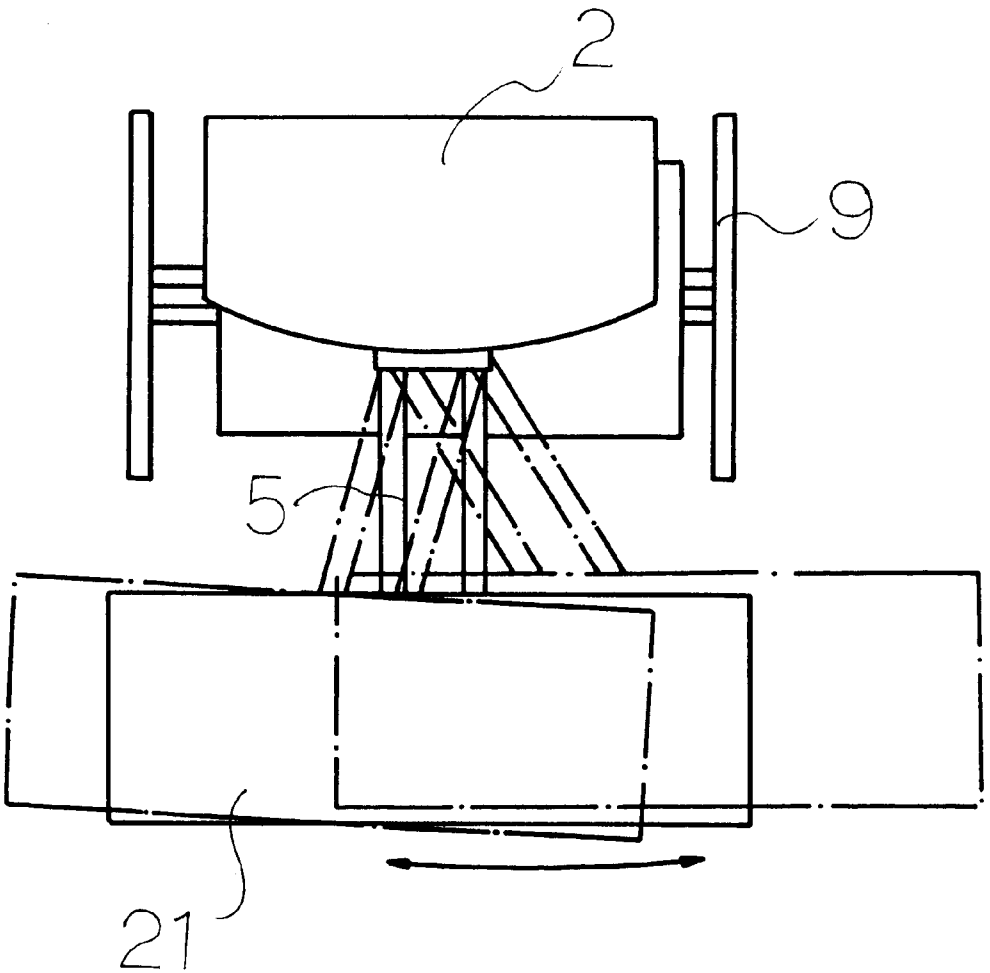
FIG. 3 shows a top view of the computer desk of the preferred embodiment of the present invention.

As shown in FIG. 2, the upright support rod 1 is provided in the proximity of the top end thereof with two pivoting pieces 31 which are fastened with the upright support rod 1. The two fastening rods 5 are parallel to each other and provided at both ends thereof with a receptacle 51 for receiving a plastic body 7 having a threaded hole engaged at one end thereof with the two pivoting pieces 31 by a screw 6, and at other end thereof with the pivoting seat 3 by two screws 6. The keyboard desktop 21 is supported by the bracket 4 in conjunction with two screws 8. The bracket 4 is supported by the pivoting seat 3. The fastening rods 5 can be moved by the rotational motions of the receptacles 51 and the plastic bodies 7. As a result, the keyboard desktop 21 is adjustable in position thereof, as illustrated in FIG. 3. It must be added here that the pivoting seat 3 has a U-shaped cross section.

Figure 4:
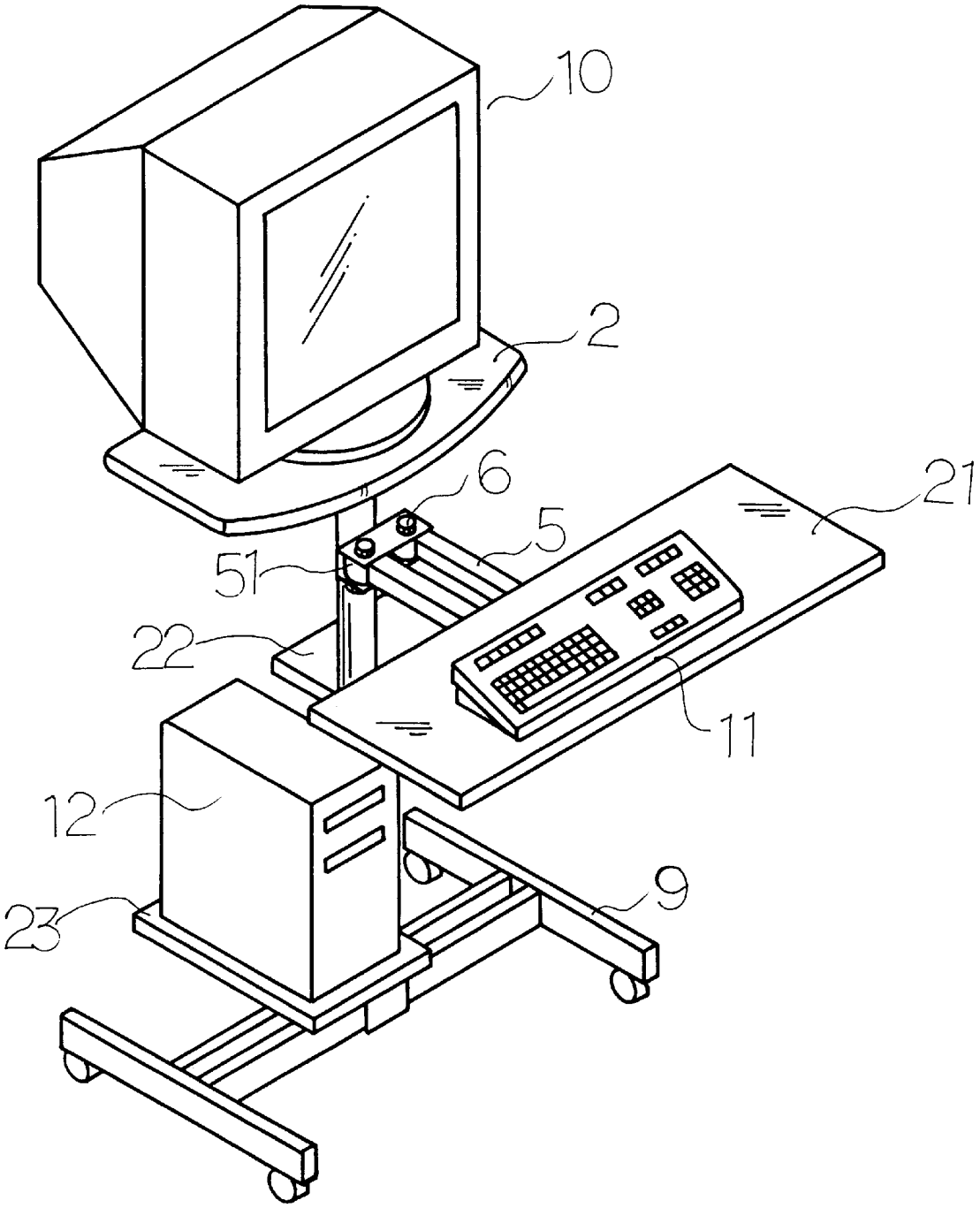
FIG. 4 shows a schematic view of the computer desk of the preferred embodiment of the present invention in use.

As illustrated in FIG. 4, a computer 10 is placed on the computer desktop 2, whereas a keyboard 11 is placed on the keyboard desktop 21. A main unit 12 is placed on the main unit desktop 23. The computer 10, the keyboard 11, and the main unit 12 do not obstruct one another.

The embodiment of the present invention described above is to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A computer desk comprising:

A support base;

An upright support rod fastened at one end thereof with said support base;

A computer desktop mounted on said upright support rod;

A main unit desktop mounted on said support base;

A periphery desktop fastened with said upright support rod such that said periphery desktop is located under said computer desktop; and A keyboard desktop adjustably fastened with said upright support rod by two pivoting pieces fastened with said upright support rod, a bracket supporting said keyboard desktop in conjunction with a pivoting seat which is fastened with one end of each of two fastening rods, with each having at both ends thereof a receptacle in which a plastic body is disposed, said two fastening rods being fastened at other end thereof with said pivoting pieces in conjunction with a fastening screw which is engaged with said plastic body.

2. The computer desk as defined in claim 1, wherein said pivoting seat has a U-shaped cross section.

3. The computer desk as defined in claim 1, wherein said support base has an I-shaped construction.

* * * * *